US005235823A

United States Patent [19]

Coker

[11] Patent Number: 5,235,823

[45] Date of Patent: Aug. 17, 1993

[54] COOLING DEVICE

[76] Inventor: William F. Coker, 3015 Ernest St., Jacksonville, Fla. 32205

[21] Appl. No.: 958,937

[22] Filed: Oct. 9, 1992

[51] Int. Cl.[5] ..... F25D 3/08

[52] U.S. Cl. ..... 62/530; 62/293; 62/457.4

[58] Field of Search ..... 62/457.2, 457.4, 457.8, 62/293, 371, 372, 529, 530, 430, 459

[56] References Cited

U.S. PATENT DOCUMENTS

| | | | |
|---|---|---|---|
| 48,941 | 7/1865 | Hinkels | 62/293 |
| 4,743,836 | 8/1988 | Marshall | 62/530 |
| 4,843,836 | 7/1989 | Childers | 62/293 |

FOREIGN PATENT DOCUMENTS

| | | | |
|---|---|---|---|
| 0452422 | 5/1913 | France | 62/530 |
| 0265755 | 2/1927 | United Kingdom | 62/530 |

*Primary Examiner*—John M. Sollecito
*Attorney, Agent, or Firm*—Thomas C. Saitta

[57] ABSTRACT

A cooling device for use with liquids in open containers, the device containing a freezable material. The cooling device is configured to have a distal end for immersion in the container, a proximal end to be positioned at the surface of the liquid, and a tapered portion whereby the maximum cross-sectional diameter of the tapered portion occurs at the distal end, with the cross-sectional dimension progressively decreasing towards the proximal end.

15 Claims, 1 Drawing Sheet

COOLING DEVICE

BACKGROUND OF THE INVENTION

This invention relates generally to cooling devices adapted to be inserted into open top containers to maintain a liquid at a cold temperature for a longer time period, the cooling devices containing a material which is frozen prior to insertion into the container. More particularly, the invention relates to such a cooling device which contains water to be frozen into ice prior to insertion.

Many beverages are best enjoyed at a cool temperature. It is well known to pre-chill the container containing the liquid beverage and to place ice cubes into the liquid to maintain the liquid at a cold temperature for a longer time period once it is removed from a refrigeration unit. For some beverages, such as beer, the addition of ice cubes is not a good solution to the warming problem, as the melting ice dilutes the beverage. The problem of the beverage warming to room temperature is increased when the beverage is served in a large container such as a pitcher.

One simple approach adopted by many establishments to solve this problem is to place a cup of ice afloat in the beverage container. This is not ideal as the ice melts, creating water which may be spilled into the container, and the cup must be removed when the container is poured. Enclosed devices with relatively thin walls containing water to be frozen have been developed which are adapted to be placed into the container. Since the device is sealed, any melted ice will not dilute the beverage. Many such devices have been patented, such as shown in U.S. Pat. No. 160,438 to Jones, U.S. Pat. No. 1,923,522 to Whitehouse, U.S. Pat. No. 2,468,661 to Gladstone, U.S. Pat. No. 4,325,230 to Driscoll, U.S. Pat. No. 4,735,063 to Brown, and U.S. Pat. No. 5,058,396 to Faiola. All of these devices are either cubes or elongated closed tubes of different cross-sections.

The main problem which decreases the efficiency of all the known devices is the fact that as the ice contained inside the device melts, it will shrink in size since the outer portion of the solid block of ice melts first. Tbe ice block in effect shrinks away from tbe walls of the device and the melt-water accumulates in the bottom of the device, causing the ice to float toward the upper portion of the device. For maximum cooling of the beverage over a period of time, it is essential that the ice remain in direct contact with the walls of the device over the greatest amount of surface area for as lone a time period as possible. Likewise, since it is the beverage at the bottom of the container that will warm over time, it is best to have most of the ice concentrated in the lower portion of the cooling device.

The invention solves the problem of decreasing cooling efficiency due to the melting of the ice by providing a unique design for the portion of the device immersed in the beverage. The cross-sectional diameter or width of the device decreases from the bottom of the device upward, thus allowing the shrinking ice block to continually maintain contact with the walls of the device even when floating upon a large amount of accumulated melt-water.

It is an object of the invention to provide a sealed cooling device for open top containers, the device having relatively thin walls and containing water which is frozen prior to immersion in the beverage container, whereby the melt-water cannot dilute the beverage.

It is a further object to provide such a device having a distal end of relatively large cross-sectional diameter or width and a tapering portion adapted to be immersed in the beverage contained in the open top container, where the cross-sectional diameter or width of the device decreases along the tapering portion of the device from the distal end towards the proximal end, such that the ice block within the device continues to directly contact the walls of the device even after significant melting occurs.

It is a further object to provide such a device having a proximal end of relatively small diameter and attachment means connected to said proximal end for attaching the device to the open top container.

SUMMARY OF THE INVENTION

The device comprises a sealed or sealable container having relatively thin walls and containing a quantity of a freezable material, such as water, the device having sufficient interior air space to allow for expansion of the material within the device upon being frozen without rupturing the walls. The device is preferably composed of an inexpensive plastic material having sufficient strength to maintain rigid walls even when not frozen. The device has a distal end which is adapted to be immersed into an open top beverage container such as a pitcher and a proximal end which is adapted to be positioned near the surface of the liquid in the container. The proximal end may be permanently sealed or releasably sealed by capping means. Preferably, attachment means for connecting the device to the handle or the top rim of the container are connected to the proximal end of the device to secure the device in place when the container is poured or tipped.

The device is configured to have a relatively large cross-sectional diameter or width at the distal end and a relatively small cross-sectional diameter or width at the proximal end, the cross-sectional diameter or width decreasing along the tapering portion of the device from the maximum diameter or width at the distal end to the minimum diameter or width at the proximal end. The majority of the length of the device is preferably composed of the tapering portion. The outermost portion of the proximal end may be configured as a tube, and the distal end may be configured as a plane, or have a relatively short extension member configured as a partial sphere, a curved surface, a tube or a polygon. The extension member has a cross-sectional diameter or width equal to or less than the maximum cross-sectional diameter or width of the tapering portion at the distal end. The tapering portion of the device is preferably conical in shape, but can also be pyramidal with any number of side walls, or any other shape having diminishing diameter or width from the distal end to the proximal end.

DETAILED DESCRIPTION OF THE DEVICE

With reference to the drawings, the preferred embodiment and best mode of the invention will now be described in detail. The invention is a sealed or sealable hollow cooling device 10 having relatively thin walls 11 and an interior space containing water, or any similar freezable material, which is frozen to create ice 97 when the device is to be used. The cooling device 10 is preferably composed of a plastic material which is easily molded into a rigid body and which is inexpensive, such as polyethylene, although it is contemplated that the device can be made of other plastics, metals or materials of similar characteristics.

Figure 1:
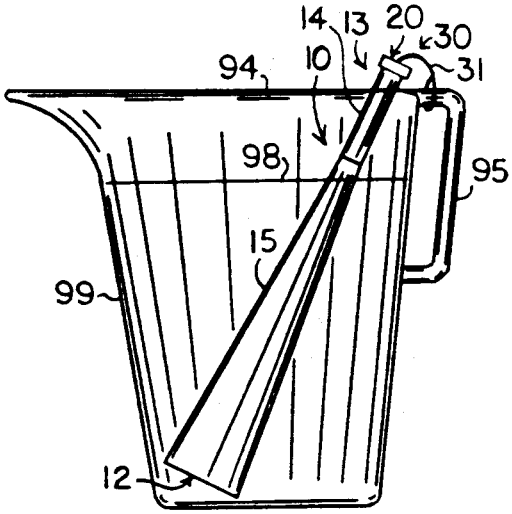
FIG. 1 shows the invention placed into a large pitcher with attachment means connecting the device to the handle of the pitcher.
Figure 2:
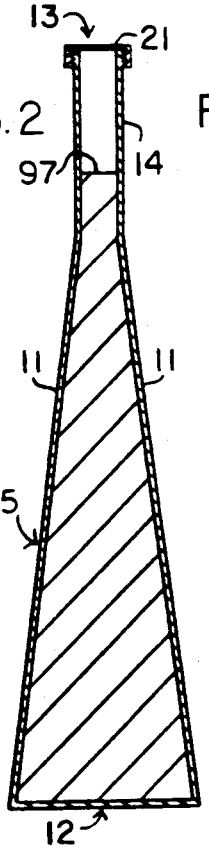
FIG. 2 is a cross-sectional view of the preferred embodiment of the device taken along line II—II of FIG. 1.

As shown in FIG. 1 and FIG. 2, the cooling device 10 is adapted to be immersed into a liquid beverage 98 contained in an open top container or pitcher 99. Depending on the size of the container 99 and of the cooling device 10, the cooling device 10 will rest vertically or at an angle within the container 99. The ice 97 then chills the beverage 98 through the thin walls 11 of the cooling device 10, maintaining the beverage 98 at the preferred cooler temperature over the period of time it takes to empty the container 99.

The cooling device 10 is comprised of a neck portion 14 and a tapering body portion 15, with a distal end 12 adapted to be immersed in the beverage 98 and a proximal end 13 adapted to be positioned at or near the surface of the beverage 98. Closure means 20 acts to seal the cooling device 10 whereby an amount of water located inside the cooling device 10 can be frozen to form a solid ice block 97 which fills the tapering body portion 15 from the distal end 12 up to the neck portion 14. The cooling device 10 is constructed with thin walls 11 so that the heat transfer between the ice 97 and the beverage 98 will have little interference. The cooling device 10 is preferably constructed of a relatively rigid plastic, such as polyethylene, but can be made of metal or other suitable material having appropriate strength and heat transfer characteristics.

The tapering body portion 15 comprises the majority of the length of the cooling device 10, with the neck portion 14 comprising a small part of the length of the cooling device 10. The neck portion 14 is preferably tubular in configuration, although other configurations are possible. The neck portion 14 may even comprise the uppermost segment of the tapering portion 15. The closure means 20 may comprise an internally threaded cap 21 adapted to mate with an externally threaded end of the proximal end 13 of the neck portion 14, as seen in FIG. 2. Alternatively, the closure means 20 may comprise a snap-fit plug 22, as shown in FIG. 5, or closure means 20 may be simply a sealed end 23, as shown in FIG. 4, or any other suitable means for closing the interior of the cooling device 10 to prevent leakage of the melt-water 96.

The tapering body portion 15 has a cross-sectional diameter or width which decreases in dimension along the length of the tapering body portion 15 as progressively measured from the distal end 12 towards the proximal end 13. The maximum cross-sectional diameter or width occur at the distal end 12. This construction allows for the majority of the ice 97 to be concentrated toward the distal end 12 of the cooling device 10. In other words, the volume of the cooling device 10 on the distal side of the midpoint is much greater than the volume on the proximal side of the midpoint. This concentrates the majority of the ice 97 in the lower half of the device 10 to maximize the cooling effects. In the preferred configuration, the tapering body portion 15 is a truncated hollow cone, as shown in FIG. 2. Alternatively, the tapering body portion 15 may be pyramidal or polygonal in shape, as shown in FIG. 4 and FIG. 5, respectively. In the preferred embodiment, the distal end 12 of the cooling device 10 has a planar bottom, as shown in FIG. 2.

Figure 4:
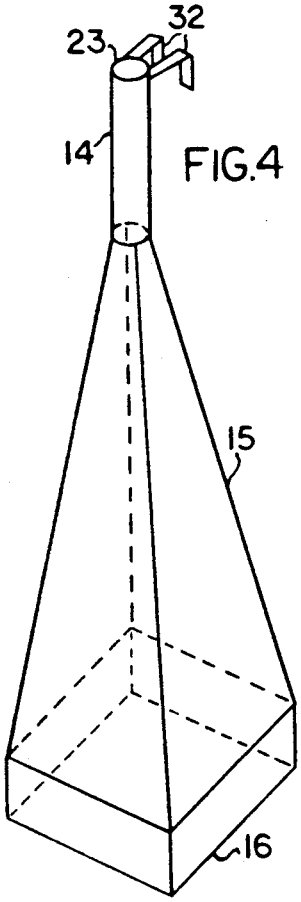
FIG. 4 is a view of an alternative embodiment of the device.
Figure 5:
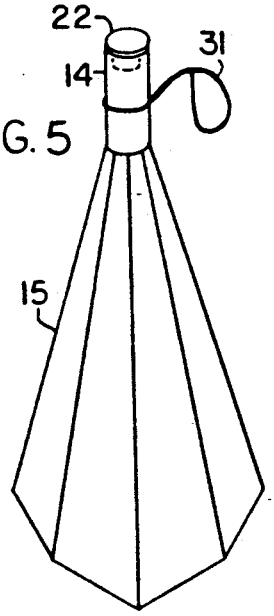
FIG. 5 is a view of another alternative embodiment of the device.
Figure 7:
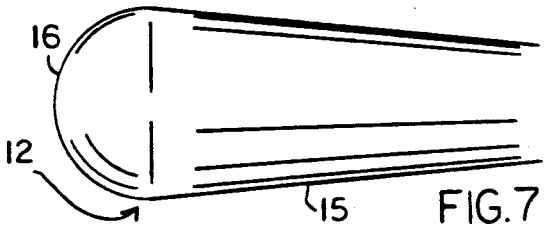
FIG. 7 is a partial view of another alternative embodiment of the device.

Alternatively, the distal end 12 may have a relatively short extension member 16 extending from the distal end 12 of the tapering body portion 15, such as a curved bottom, as shown in FIG. 7, or an extended polygon, as shown in FIG. 4. The longitudinal length of the extension member 16 should be no greater than twenty percent of the overall length of the cooling device 10, and preferably no greater than twelve percent of the overall length. The cross-sectional diameter or width of the extension member 16 must be no greater than the maximum cross-sectional dimension of the tapering body portion 15. The extension member 16 provides an increase in surface area for contact between the liquid beverage 98 and the ice 97.

Figure 6:
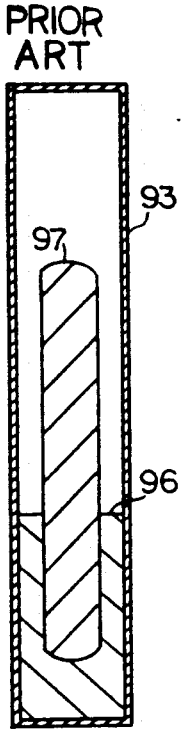
FIG. 6 is a cross-sectional view, similar to FIG. 2, of a prior art device of tubular configuration illustrating the position of the ice after some melt-water has accumulated.
Figure 3:
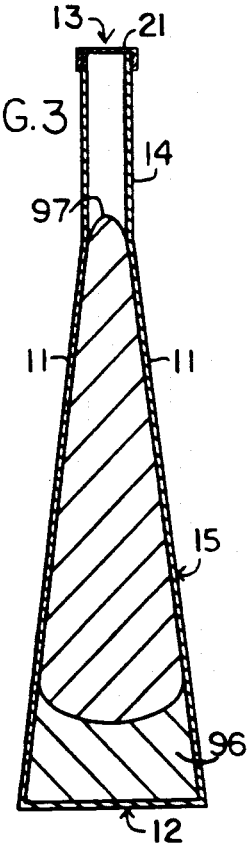
FIG. 3 is the same view as FIG. 2, but illustrating the contact of the ice to the walls of the device after the ice has begun melting.

The tapering body portion 15 acts to maintain the ice 97 in contact with the walls 11 of the cooling device 10 even after a significant portion of the ice 97 has melted to create a pool of melt-water 96. In prior art devices of tubular configuration, as seen in FIG. 6, when the ice 97 melts it shrinks from the walls of the tubular cooling device 93 and floats in the pool of melt-water 96. This dramatically decreases the cooling efficiency of the device. Referring now to FIG. 3, it is seen that with the cooling device 10 of the invention, as the ice 97 melts the melt-water 96 acts to continuously force the ice 97 against the walls 11 of the tapering body portion 15 of the cooling device 10. As more ice 97 melts, more melt-water 96 forms, and even though the ice 97 shrinks in cross-section as it melts, the ice 97 floats higher within the tapering body portion 15 and wall contact is maintained.

The following table illustrates experimental data demonstrating the improved cooling efficiency of the invention in a pre-chilled container as opposed to a tubular cooling device and no cooling device.

| ELAPSED TIME | CONTAINER W/NO DEVICE | CONTAINER W/ TUBULAR DEVICE | CONTAINER W/ INVENTION |
|---|---|---|---|
| 0 minutes | 40 deg. F. | 40 deg. F. | 40 deg. F. |
| 15 | 45 | 39 | 38 |
| 30 | 47 | 41 | 39 |
| 45 | 50 | 45 | 41 |
| 60 | 53 | 49 | 43 |
| 75 | 55 | 52 | 44 |
| 90 | 58 | 54 | 45 |
| 105 | 60 | 56 | 45 |
| 120 | 62 | 58 | 46 |

It is preferred that the cooling device 10 further comprise attachment means 30 to secure or fix the device to the container 99 such that the container 99 may be poured or tipped without the need to remove the cooling device 10. This may be accomplished in any known manner, such as by a string loop 31 connected to the closure means 20 and fastened or tied around the handle 95 of a pitcher 99, as seen in FIG. 1. Alternatively, the loop 31 may be affixed around the neck portion 14, as seen in FIG. 5. In still another embodiment, the attachment means 30 may comprise a clip or prongs 32 which grasp the rim 94 or the handle 95 of the container 99.

While it is envisioned that the cooling device 10 may be utilized with any type or size of container 99, including pitchers, glasses, mugs, cups, etc., it is envisioned that the most common use will be associated with large pitchers as shown in FIG. 1. In this case, suitable dimensions, for purposes of illustration, could be approximately nine inches in overall length, with a neck portion 14 approximately two inches in length and one half inch in diameter. The tapering body portion 15 is approximately six inches in length and decreases from approximately two inches in diameter at the distal end 12 to one half inch in diameter where it meets the neck portion 14. A semi-spherical extension member 16 could extend one inch beyond the tapering body portion 14. A device of this size and configuration will contain roughly six ounces of water. For use with smaller containers 99, such as glasses or mugs, the cooling device 10 would be proportionally smaller in all aspects.

The above examples and illustrations are by way of example only, and those skilled in the art may be aware of obvious substitutions or equivalents. The true definition and scope of the invention therefore is to be as set forth in the following claims.

I claim:

1. A sealed cooling device adapted to be placed into an open container to cool a liquid beverage contained therein, the cooling device comprising:

(A) a thin-walled, non-insulated permanently sealed distal end composed of a material having high heat transfer characteristics, adapted to be immersed in said beverage and a proximal end adapted to be positioned at or near the surface of said beverage;

(B) a thin-walled, non-insulated tapering body portion of diminishing cross-section progressing from said distal end toward said proximal end composed of a material having high heat transfer characteristics, where the maximum cross-section of said tapering body portion occurs at said distal end; and (c) a freezable material completely sealed within said cooling device, whereby the configuration of said sealed distal end and said tapering body portion comprise means to maintain direct contact of said freezable material, when melting with said tapering body portion thereby improving the efficiency of said device.

2. The device of claim 1, further comprising a neck portion at said proximal end.

3. The device of claim 1, further comprising means to attach said device to said container.

4. The device of claim 1, further comprising releasable sealing mean to seal said device.

5. The device of claim 1, where said tapering body portion has the shape of a cone.

6. The device of claim 1, where said tapering body portion has the shape of a pyramid.

7. The device of claim 1, where the freezable material is water.

8. The device of claim 1, further comprising a short extension member extending from said distal end of said tapering body portion, where the cross-sectional dimension of said extension member is no greater than the cross-sectional dimension of said distal end, and where the length of said extension member is no greater than 20 percent of the overall length of said cooling device.

9. The device of claim 2, where said neck portion is tubular.

10. The device of claim 3, where said attachment means comprises a looped string.

11. The device of claim 3, where said attachment means comprises a clip.

12. The device of claim 4, where said sealing means comprises a threaded cap.

13. The device of claim 4, where said sealing means comprises a plug.

14. The device of claim 1, where said device is composed of a plastic material.

15. The device of claim 8, where the length of said extension member is no greater than 12 percent of the overall length of the cooling device.

* * * * *